US009680267B2

(12) United States Patent
Hashiguchi

(10) Patent No.: US 9,680,267 B2
(45) Date of Patent: Jun. 13, 2017

(54) DOWNSIZED CONNECTOR HAVING A STRUCTURE THAT IS TOLERANT OF TWIST

(71) Applicant: JAPAN AVIATION ELECTRONICS INDUSTRY, LIMITED, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/017,858

(22) Filed: Feb. 8, 2016

(65) Prior Publication Data

US 2016/0308316 A1 Oct. 20, 2016

(30) Foreign Application Priority Data

Apr. 15, 2015 (JP) ..... 2015-083615

(51) Int. Cl.
*H01R 12/00* (2006.01)
*H01R 24/84* (2011.01)
*H01R 12/71* (2011.01)

(52) U.S. Cl.
CPC ..... *H01R 24/84* (2013.01); *H01R 12/716* (2013.01)

(58) Field of Classification Search
CPC ..... H01R 9/096; H01R 23/725; H01R 23/27; H01R 13/28; H01R 23/7073
USPC ..... 439/65, 74, 284, 290–292, 660
See application file for complete search history.

(56) References Cited

U.S. PATENT DOCUMENTS 5,161,985 A 11/1992 Ramsey
5,181,855 A * 1/1993 Mosquera ..... H01R 13/28 439/291
5,498,167 A * 3/1996 Seto ..... H01R 12/716 439/284
5,876,217 A * 3/1999 Ito ..... H01R 13/20 439/74
5,915,976 A * 6/1999 McHugh ..... H01R 23/6873 439/108
6,764,314 B1 * 7/2004 Lee ..... H01R 12/57 439/65
7,179,108 B2 2/2007 Goodman et al.
7,371,096 B2 5/2008 Goodman et al.
(Continued)

FOREIGN PATENT DOCUMENTS

JP H 4-308674 A 10/1992
JP H 6-510158 A 11/1994
(Continued)

*Primary Examiner* — Thanh Tam Le
(74) *Attorney, Agent, or Firm* — Collard & Roe, P.C.

(57) ABSTRACT

A connector comprises first contacts, second contacts and a housing. The first contacts have first contact portions which come into contact with first mating contacts. The second contacts have second contact portions which come into contact with second mating contacts. The housing has at least two long wall portions and at least one supporting portion. The long wall portions extend in an X-direction and are disposed apart from each other in a Y-direction to form a slot between the two of the long wall portions. The supporting portion protrudes in a Z-direction from one of the long wall portions and has a plate-like shape extending in the X-direction. The first contact portions are supported by the supporting portion. The second contact portions are located in the slot at least in part.

9 Claims, 14 Drawing Sheets

(56) References Cited

U.S. PATENT DOCUMENTS

| | | | | |
|---|---|---|---|---|
| 7,785,152 | B2 * | 8/2010 | Yi | H01R 13/514 439/660 |
| 7,794,238 | B2 * | 9/2010 | Chen | H01R 13/20 439/660 |
| 8,277,241 | B2 * | 10/2012 | Horchler | H01R 13/6271 439/295 |
| 8,540,534 | B2 * | 9/2013 | Sato | H01R 13/11 439/660 |

FOREIGN PATENT DOCUMENTS

| | | | |
|---|---|---|---|
| JP | H 7-161415 | A | 6/1995 |
| JP | 2001-307846 | A | 11/2001 |
| JP | 2008-512842 | A | 4/2008 |

* cited by examiner

PPIOR ART

DOWNSIZED CONNECTOR HAVING A STRUCTURE THAT IS TOLERANT OF TWIST

CROSS REFERENCE TO RELATED APPLICATIONS

Applicant claims priority under 35 U.S.C. §119 of Japanese Patent Application No. JP2015-083615 filed Apr. 15, 2015.

BACKGROUND OF THE INVENTION

This invention relates to a connector which is provided with at least two kinds of contacts.

A connector of this type is disclosed in JP 1995-161415 A (Patent Document 1), for example. As shown in FIG. 26, the connector 900 of Patent Document 1 is provided with a first contact 910, a second contact 920, a ground contact 930 and a housing 940 holding them. The housing 940 has a supporting portion 942 of plate-like shape and a slot 946 formed between long wall portions 944. The first contact 910 is supported by the supporting portion 942 in part. The second contact 920 is accommodated by the slot 946 in part. In other words, the second contact 920 is located between the long wall portions 944 in part. The connector 900 is mateable with a mating connector 950 having the same structure as the connector 900. Thus, each of the connector 900 and the mating connector 950 is a hermaphroditic connector. When the connector 900 is mated with the mating connector 950, the first contact 910 of the connector 900 is inserted into the second contact 920 of the mating connector 950 while the second contact 920 of the connector 900 receives the first contact 910 of the mating connector 950. Then, the ground contact 930 of the connector 900 is connected to the ground contact 930 of the mating connector 950. Because of the structure mentioned above, the connector 900 and the mating connector 950 are tolerant of twist when they are mated with each other.

SUMMARY OF THE INVENTION

It is an object of the present invention to provide a connector that is downsized and is tolerant of twist.

One aspect of the present invention provides a connector which is mateable with a mating connector along a first direction. The mating connector has a plurality of first mating contacts and a plurality of second mating contacts. The connector comprises a plurality of first contacts, a plurality of second contacts and a housing which holds the first contacts and the second contacts. The first contacts each have first contact portions which come into contact with the first mating contacts when the connector is mated with the mating connector. The second contacts each have second contact portions which come into contact with the second mating contacts when the connector is mated with the mating connector. The housing has at least two long wall portions and at least one supporting portion. The long wall portions extend in a second direction perpendicular to the first direction. The long wall portions are disposed apart from each other in a third direction perpendicular to both of the first direction and the second direction to form a slot between the two of the long wall portions. The supporting portion protrudes in the first direction from one of the long wall portions and has a plate-like shape extending in the second direction. The first contact portions are supported by the supporting portion. The second contact portions are located in the slot at least in part.

Another aspect of the present invention provides a connector assembly comprising the connector and the mating connector.

The supporting portion supporting the first contacts extends in a mating direction, i.e. the first direction, from the long wall portion which forms the slot accommodating the second contacts. Therefore, a space can be omitted between the long wall portion and the supporting portion so that the connector can be downsized.

An appreciation of the objectives of the present invention and a more complete understanding of its structure may be had by studying the following description of the preferred embodiment and by referring to the accompanying drawings.

Figure 1:
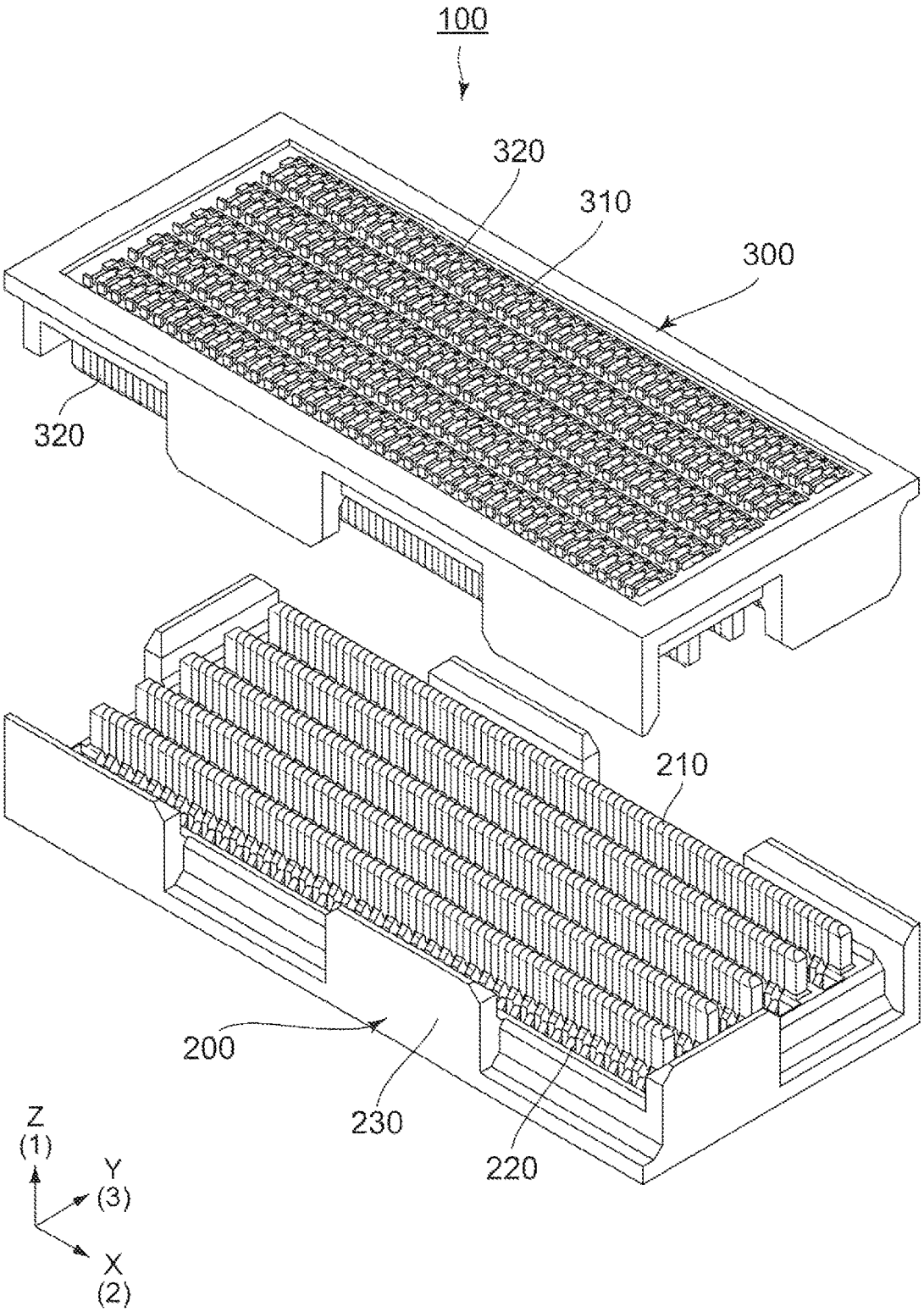
FIG. 1 is a perspective view showing a connector assembly according to a first embodiment of the present invention. A first connector and a second (or mating) connector of the connector assembly are not mated with each other.
Figure 2:
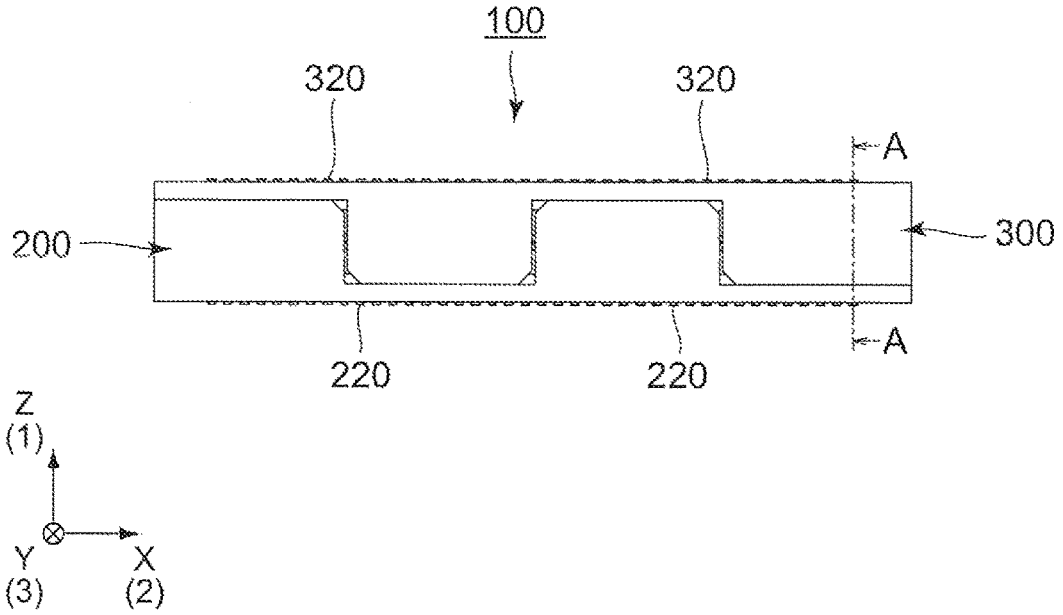
FIG. 2 is a front view showing a mating state of the connector assembly of FIG. 1.
Figure 3:
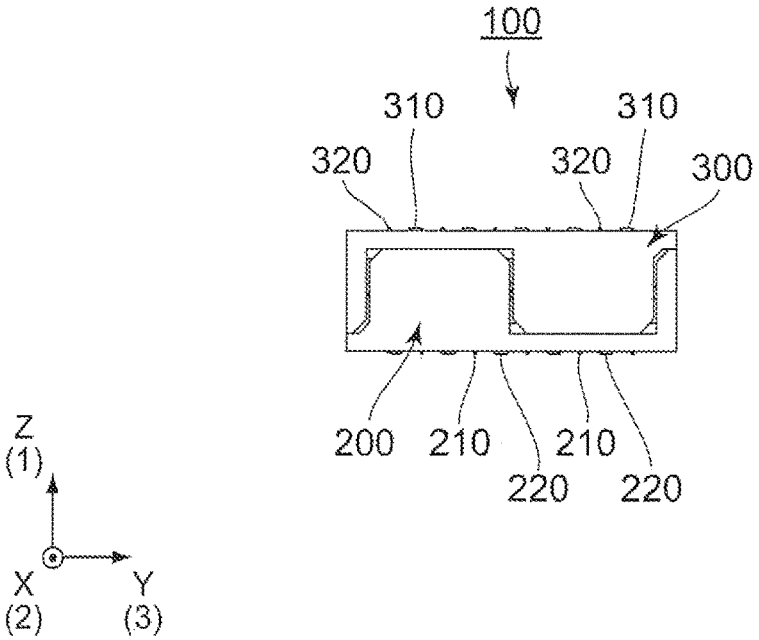
FIG. 3 is a right side view showing the mating state of the connector assembly of FIG. 1.
Figure 4:
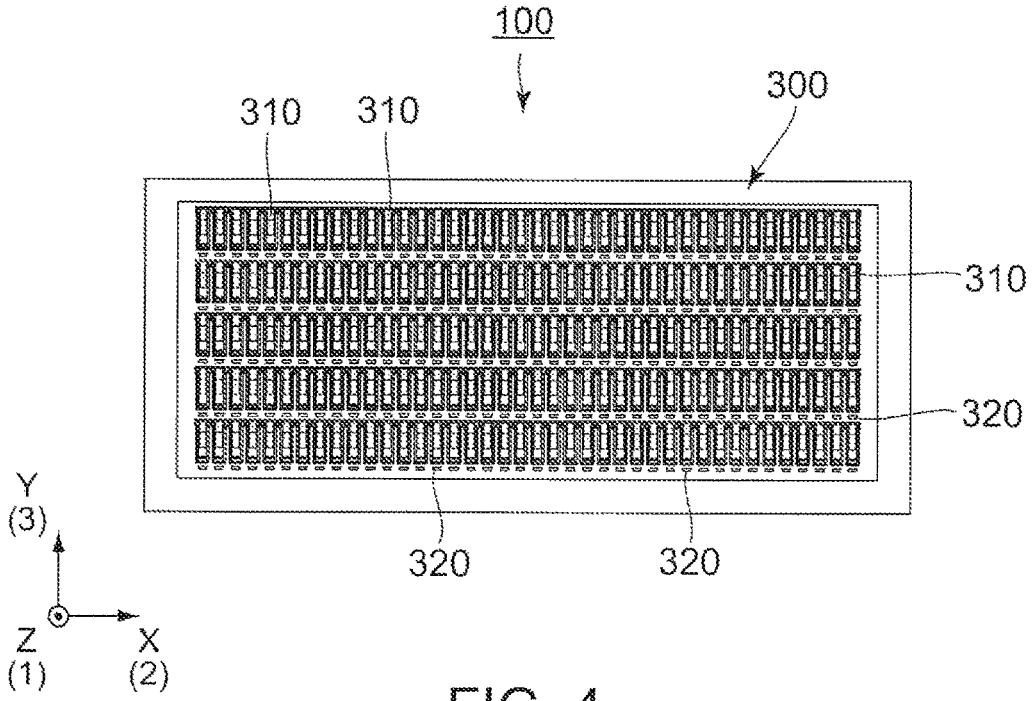
FIG. 4 is a top view showing the mating state of the connector assembly of FIG. 1.
Figure 5:
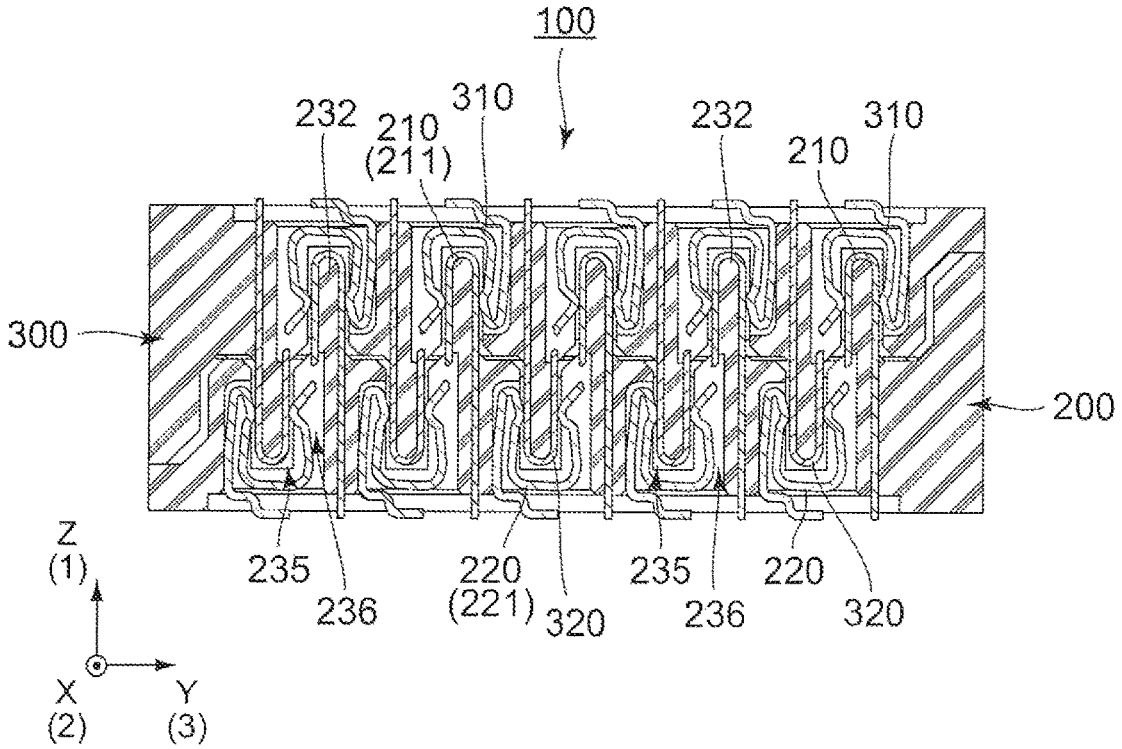
FIG. 5 is a cross-sectional view of the connector assembly of FIG. 2, taken along A-A line.
Figure 6:
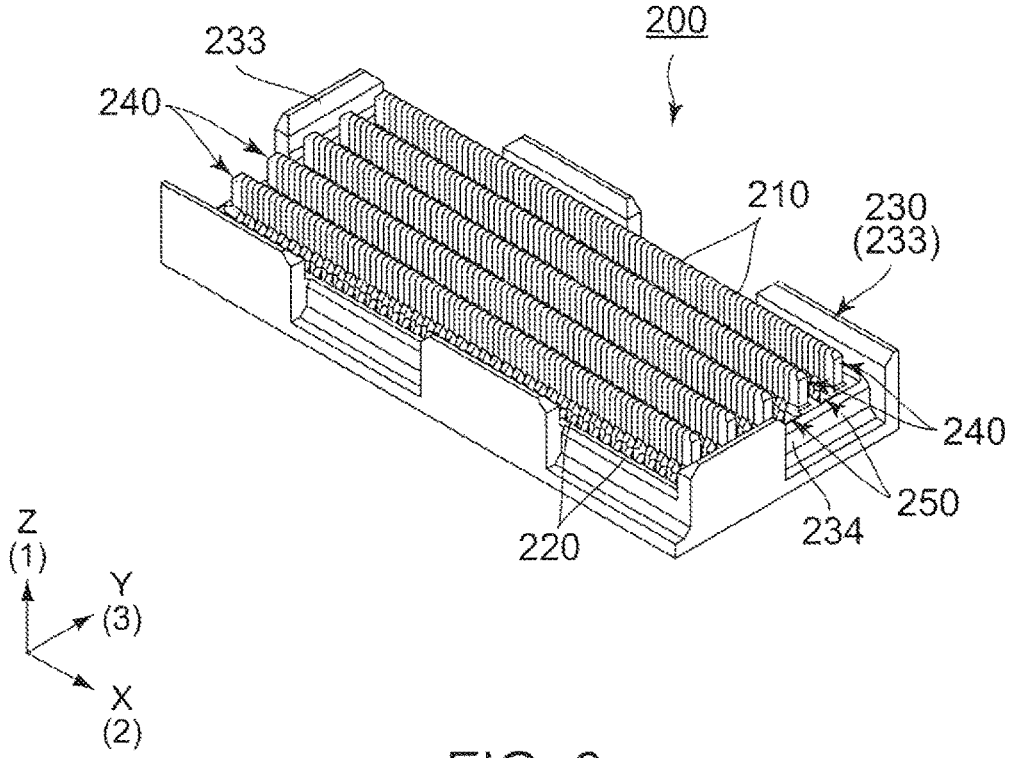
FIG. 6 is a perspective view of the first connector used in the connector assembly of FIG. 1.
Figure 7:
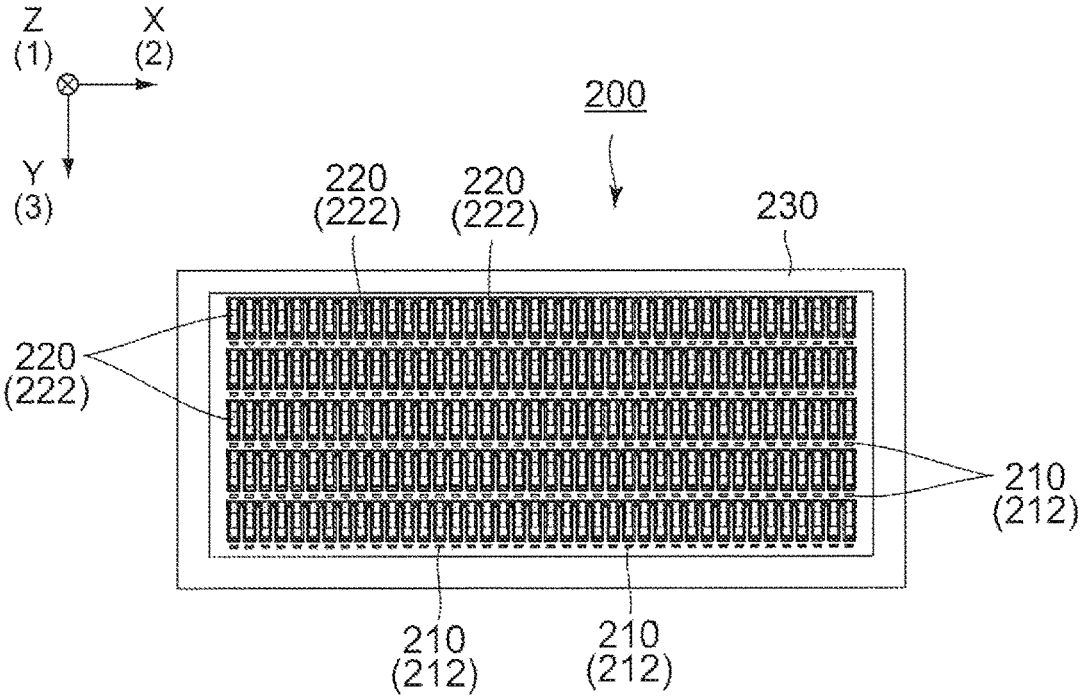
FIG. 7 is a bottom view of the first connector of FIG. 6.
Figure 8:
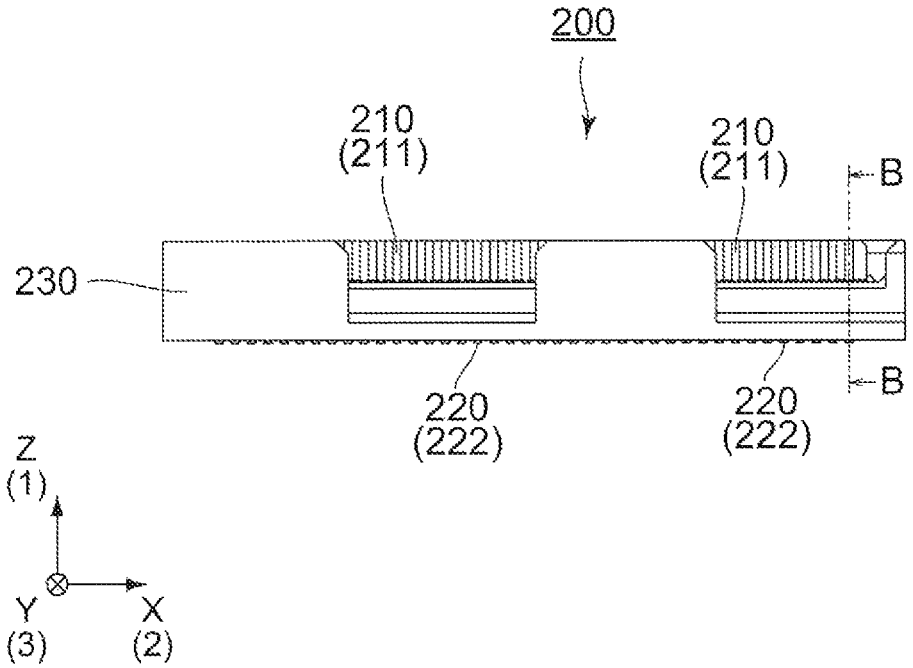
FIG. 8 is a front view of the first connector of FIG. 6.
Figure 9:
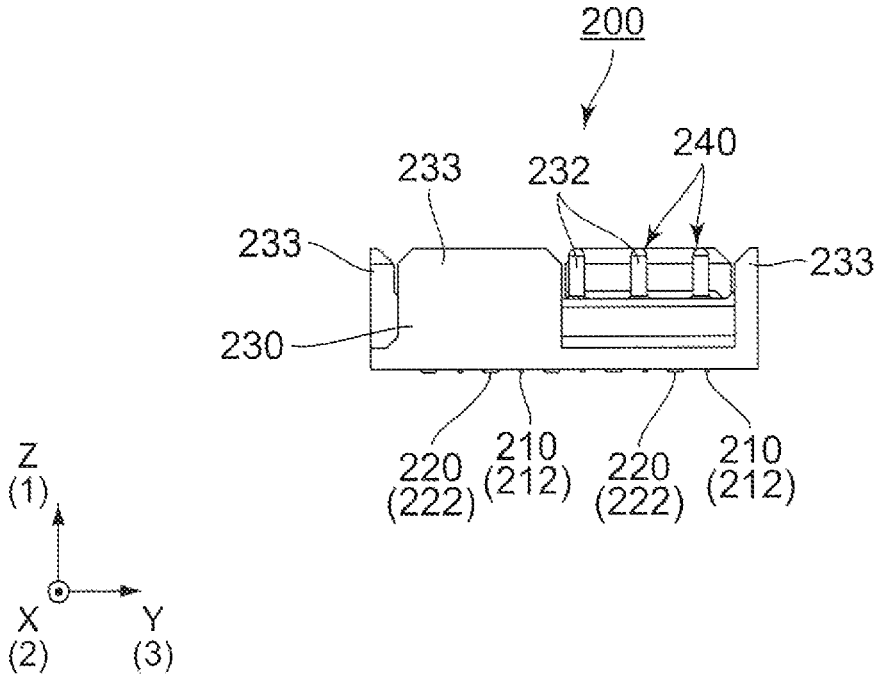
FIG. 9 is a right side view of the first connector of FIG. 6.
Figure 10:
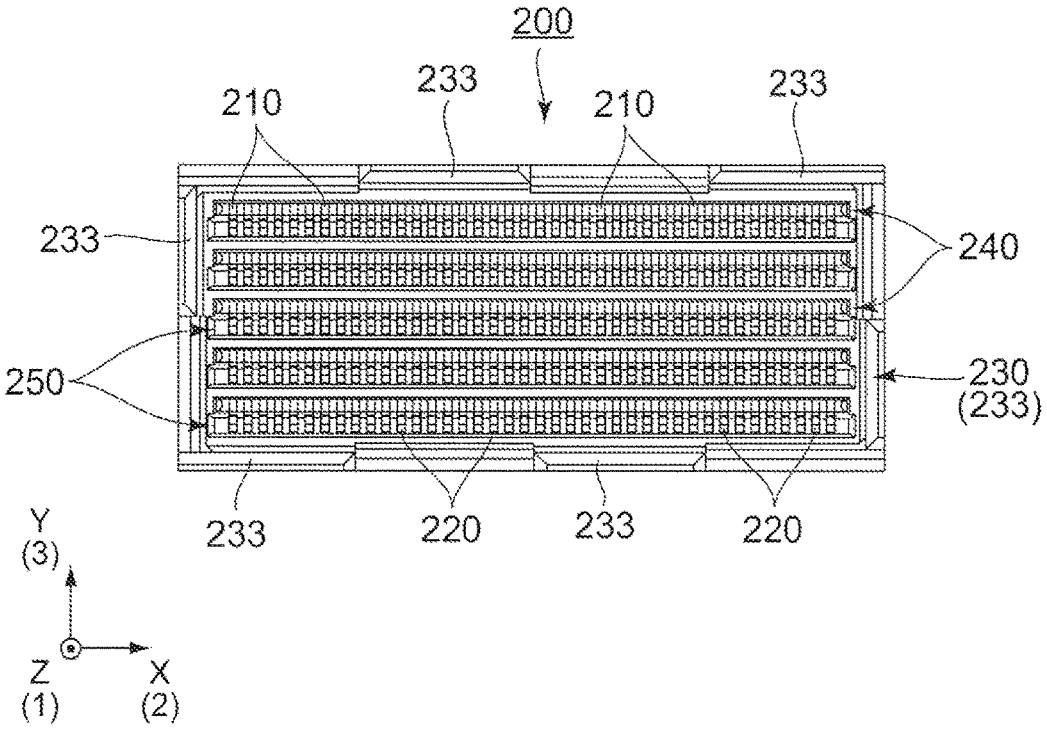
FIG. 10 is a top view of the first connector of FIG. 6.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Preferred embodiments of the present invention will be described below with reference to attached drawings.

First Embodiment

As shown in FIG. 1, a connector assembly 100 according to a first embodiment of the present invention has first and second connectors 200 and 300. The first and the second connectors 200 and 300 have structures same as each other, and each of them is a hermaphroditic connector. The first and the second connectors 200 and 300 are mateable with each other along a first direction as understood from FIGS. 2 to 5. The first and the second connectors 200 and 300 are also removable from each other along the first direction. The first direction is equivalent to a Z-direction in the present embodiment.

As described later with reference to FIGS. 6 to 11, the first connector 200 has a plurality of first contacts 210 and a plurality of second contacts 220. As understood from FIG. 5, when the first connector 200 is mated with the second connector 300, which is a mating connector thereof, the first contacts 210 are individually accommodated by first mating contacts 310 of the second connector 300 in part. Moreover, the second contacts 220 individually accommodate second mating contacts 320 of the second connector 300 in part. Thus, the first contacts 210 come into contact with the first mating contacts 310 while the second contacts 220 come into contact with the second mating contacts 320.

As mentioned above, the first and the second connectors 200 and 300 have the structures same as each other. Accordingly, the following description will be mainly made about the first connector 200.

Referring to FIGS. 6 to 11, the first connector 200 has the first contacts 210, the second contacts 220 and a housing 230 that holds the first and the second contacts 210 and 220.

The first contacts 210 are arranged to form at least one first contact row 240 extending along a second direction. When a plurality of the first contact rows 240 is provided in the first connector 200, the first contact rows 240 are arranged at prescribed intervals along a third direction perpendicular to the second direction. The second and the third directions are equivalent to X- and Y-directions, respectively, in the present embodiment. Accordingly, the second and the third directions each are perpendicular to the first direction. The first contacts 210 of the present embodiment are arranged at first intervals along the second direction and at second intervals along the third direction to form five of the first contact rows 240.

The second contacts 220 are arranged in the same manner as the first contacts 210. In other words, the second contacts 220 form at least one second contact row 250. The second contacts 220 are arranged at the first intervals along the second direction and at the second intervals along the third direction in the present embodiment.

The first contacts 210 are equal to the second contacts 220 in number. Moreover, the first contact rows 240 and the second contact rows 250 are alternately arranged in the third direction. Accordingly, each of the first contacts 210 is adjacent to corresponding one of the second contacts 220, which is located at one side (or a negative Y-direction side) of the first contact 210, in the third direction.

Figure 11:
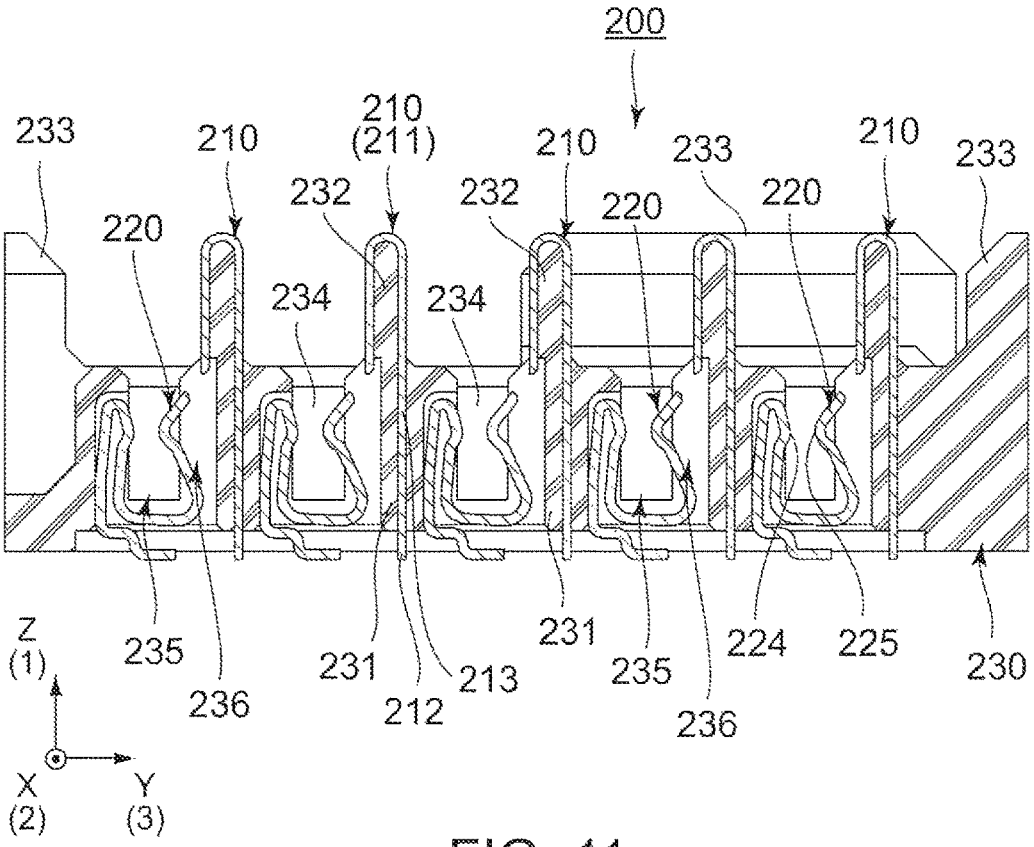
FIG. 11 is a cross-sectional view of the first connector of FIG. 8, taken along B-B line.

The housing 230 has at least two long wall portions 231, at least one supporting portion 232 and a plurality of guide portions 233, as understood from FIG. 11.

The long wall portions 231 each protrude in the first direction and extend along the second direction. Moreover, the long wall portions 231 are disposed at prescribed intervals in the third direction. As understood from FIG. 6, adjacent two of the long wall portions 231 are coupled with each other by short wall portions 234 at their both ends of the second direction. The short wall portions 234 are formed to protrude in the first direction and extend along the third direction. The adjacent two long wall portions 231 and the short wall portions 234, which couple the adjacent two long wall portions 231 together, define a slot 235 surrounded by them, as understood from FIG. 11. In the present embodiment, the slots 235 are five in number. Each of the slots 235 is located between the adjacent two long wall portions 231 corresponding thereto. The slots 235 correspond to the second contact rows 250, respectively.

Between the adjacent two long wall portions 231, contact accommodation portions 236 are formed to correspond to the second contacts 220, respectively, and open into the slot 235. It can be said that the contact accommodation portions 236 are portions of the slot 235. The contact accommodation portions 236 accommodate a part of the second contacts 220 corresponding thereto.

Each of the supporting portions 232 is formed to protrude from a corresponding one of the long wall portions 231 in the first direction and extend along the second direction. The supporting portions 232 have a plate-like shape. The supporting portions 232 correspond to the first contact rows 240, respectively.

The guide portions 233 are arranged along a periphery of the first connector 200. The guide portions 233 guide the first connector 200 to a suitable position relative to the second connector 300 when the first connector 200 is mated with the second connector 300.

Figure 12:
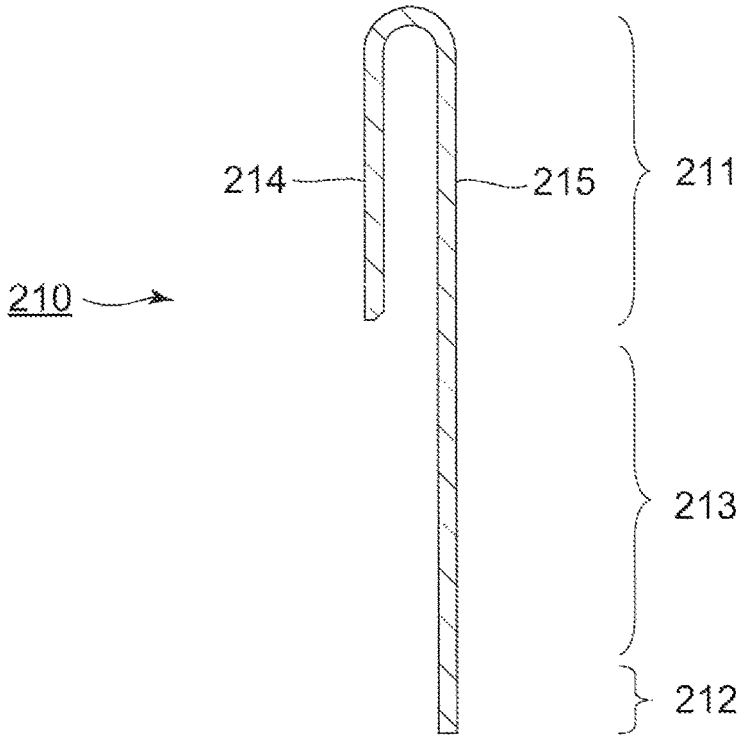
FIG. 12 is an enlarged cross-sectional view of a first contact included in the first connector of FIG. 11.

As shown in FIG. 12, each of the first contacts 210 has a first contact portion 211, a first fixing portion 212 and a first coupling portion 213 coupling the first contact portion 211 with the first fixing portion 212.

Figure 14:
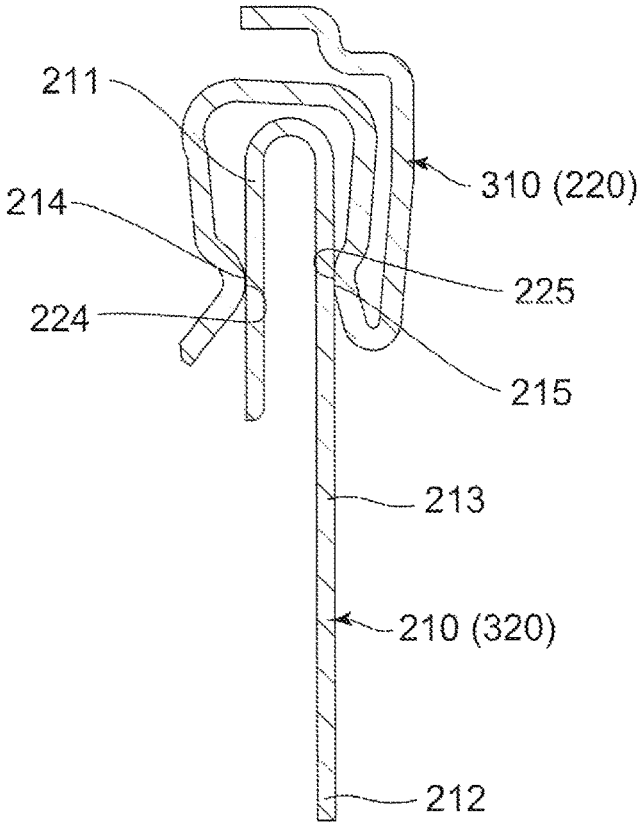
FIG. 14 is an enlarged cross-sectional view for illustrating contact points of the first contact of FIG. 12 and contact points of the second contact of FIG. 13.
Figure 15:
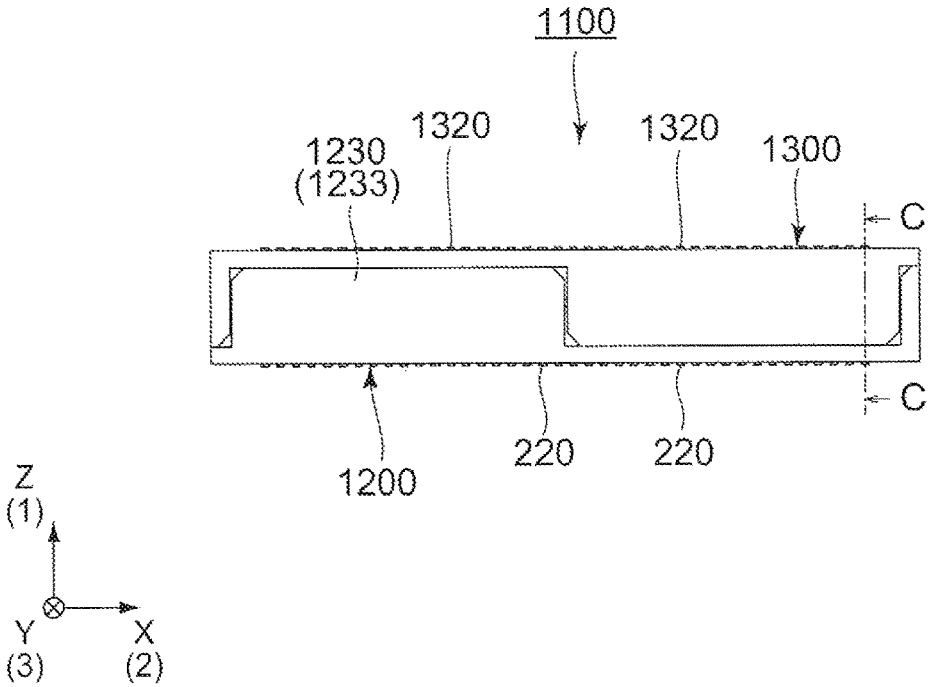
FIG. 15 is a front view of a connector assembly, which is in a mating state, according to a second embodiment of the invention.
Figure 16:
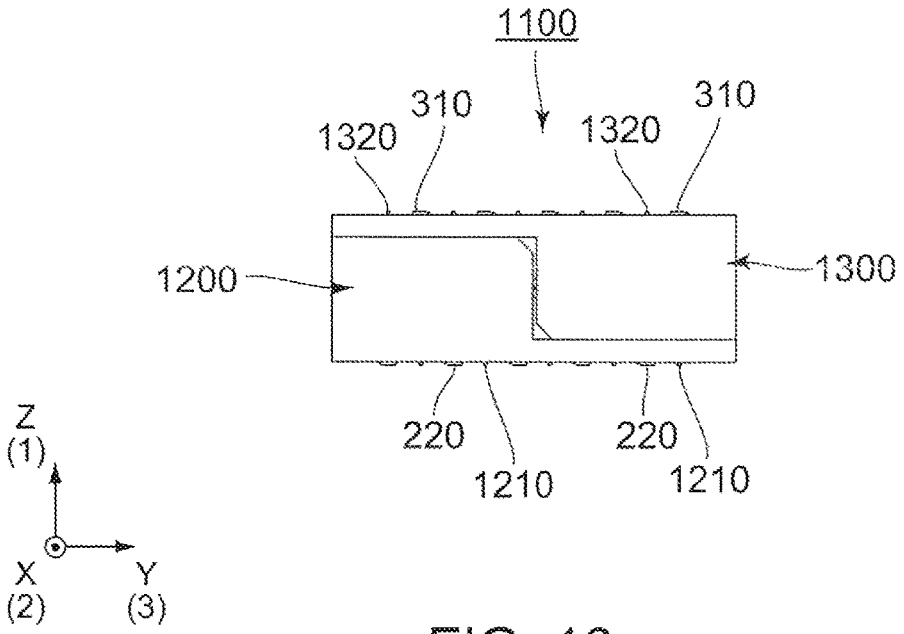
FIG. 16 is a right side view of the connector assembly of FIG. 15.
Figure 17:
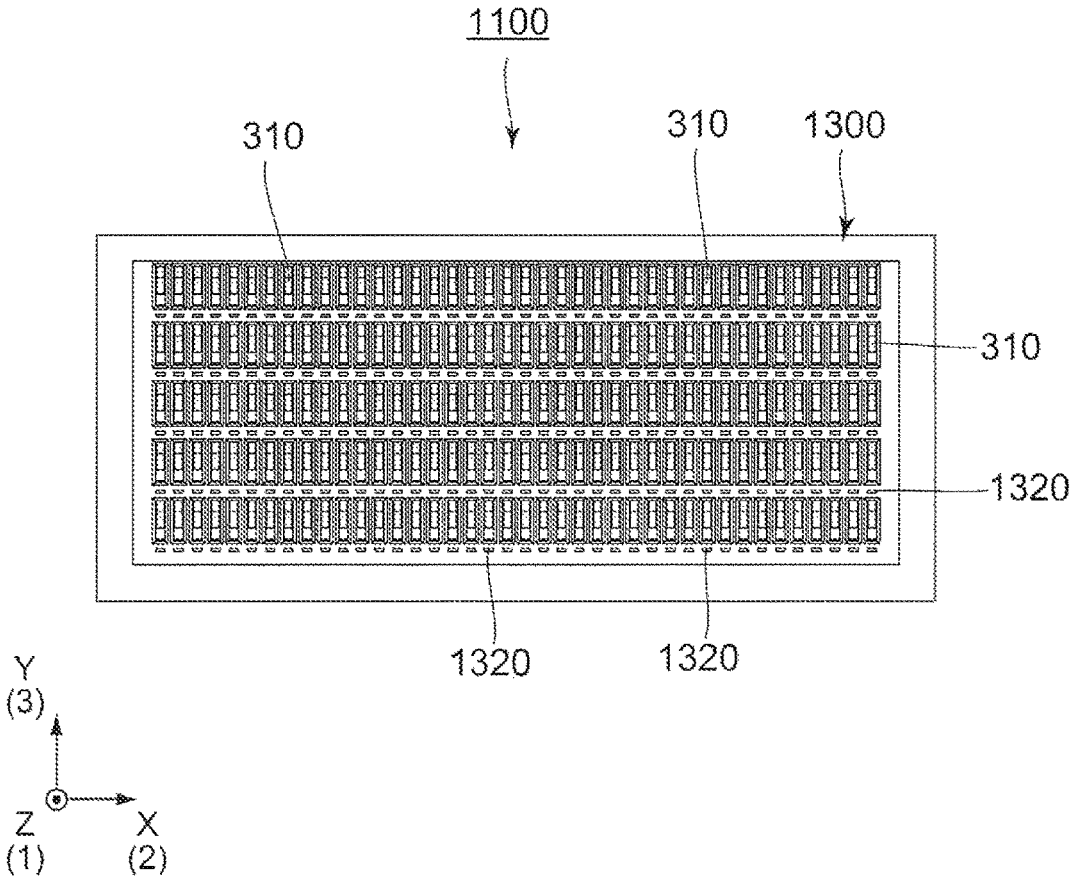
FIG. 17 is a top view of the connector assembly of FIG. 15.
Figure 18:
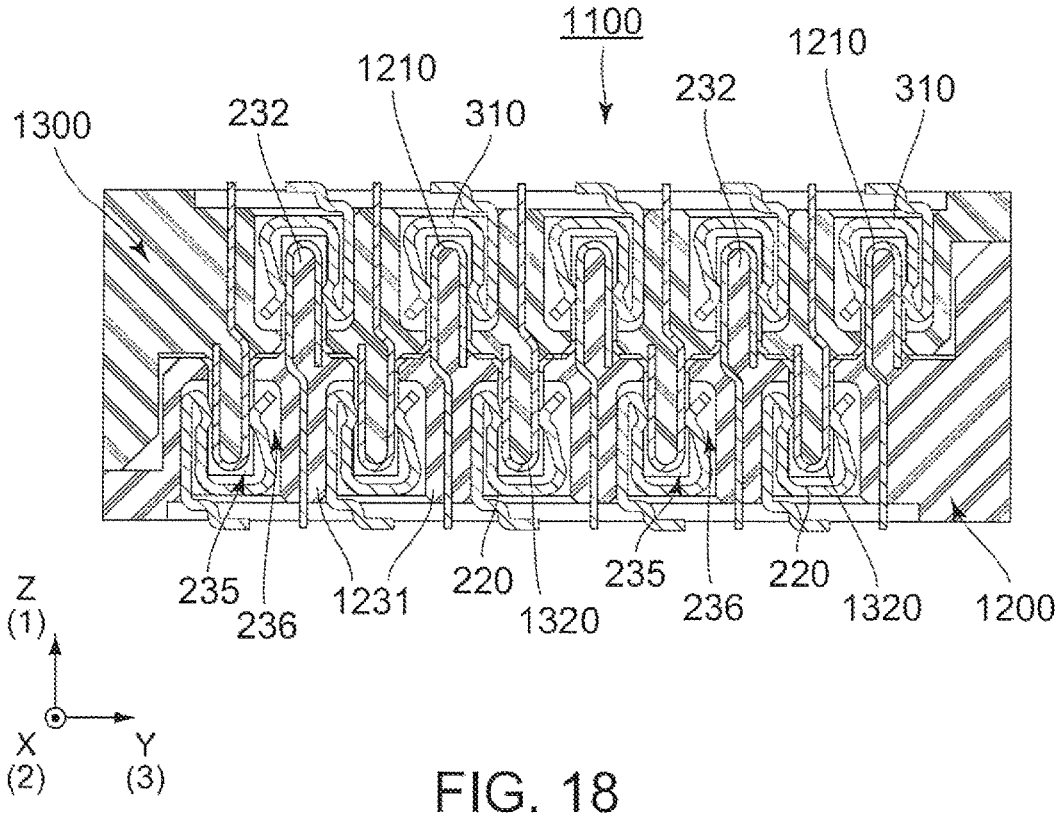
FIG. 18 is a cross-sectional view of the connector assembly of FIG. 15, taken along C-C line.
Figure 19:
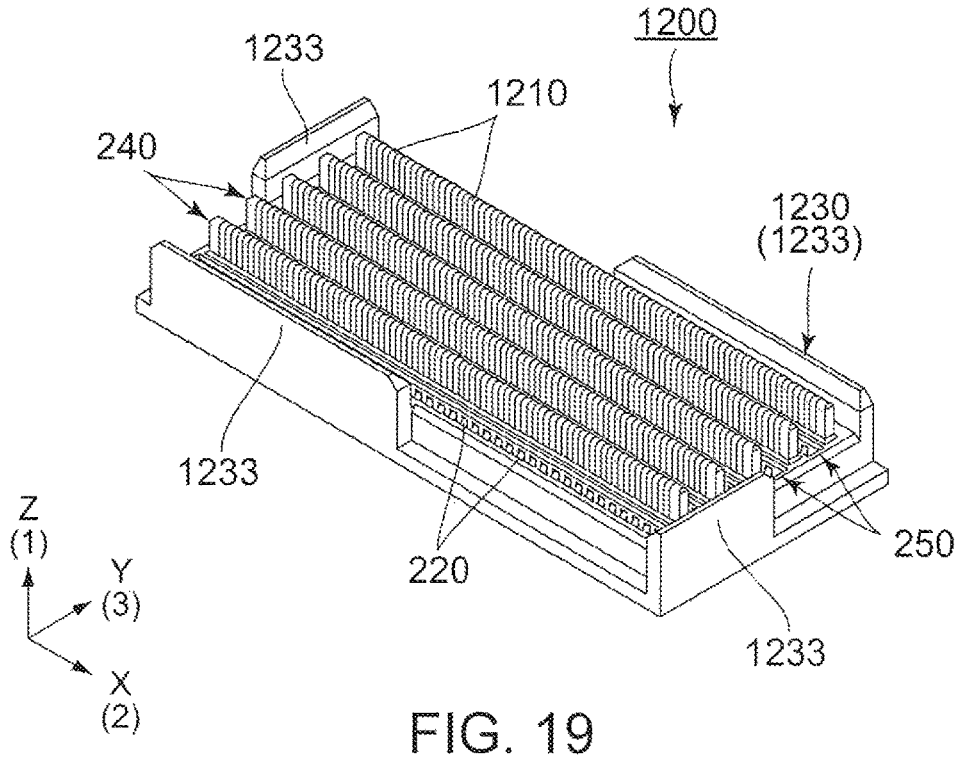
FIG. 19 is a perspective view of a first connector used in the connector assembly of FIG. 15.
Figure 20:
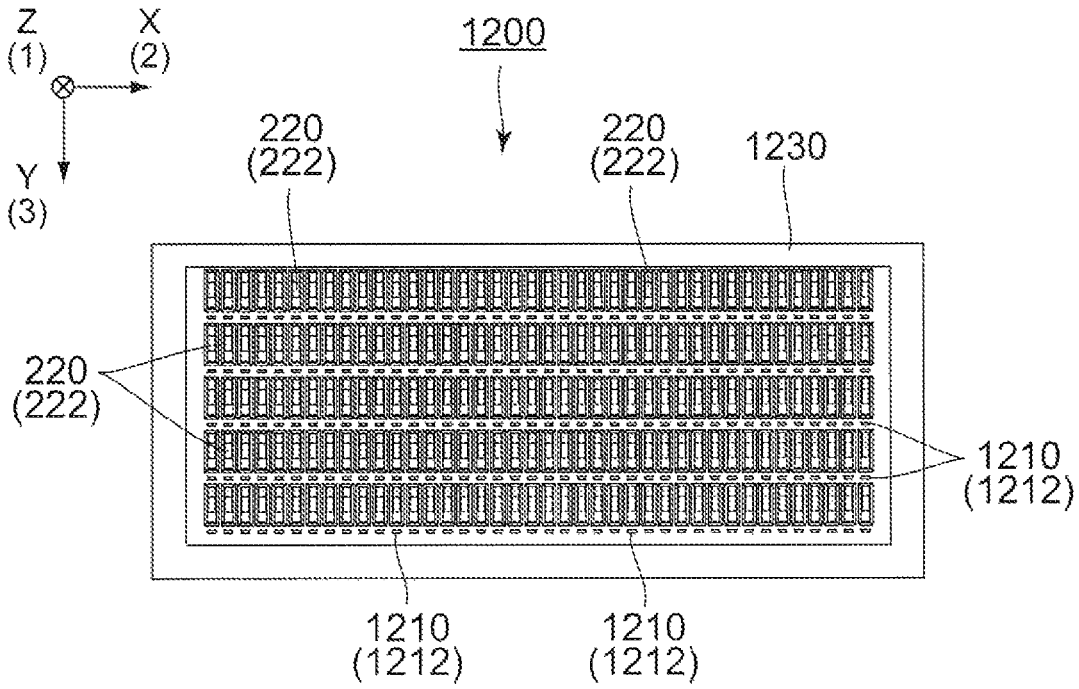
FIG. 20 is a bottom view of the first connector of FIG. 19.
Figure 21:
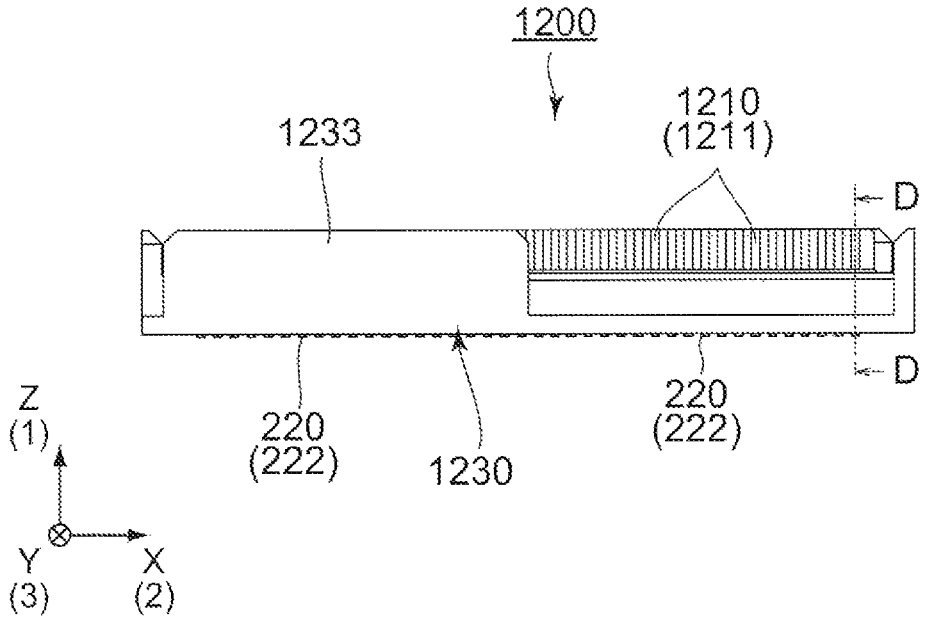
FIG. 21 is a front view of the first connector of FIG. 19.
Figure 22:
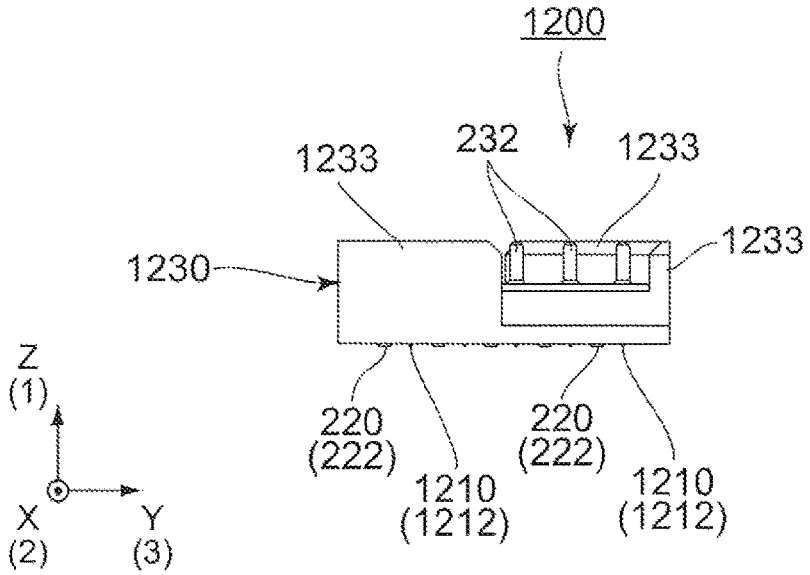
FIG. 22 is a right side view of the first connector of FIG. 19.
Figure 23:
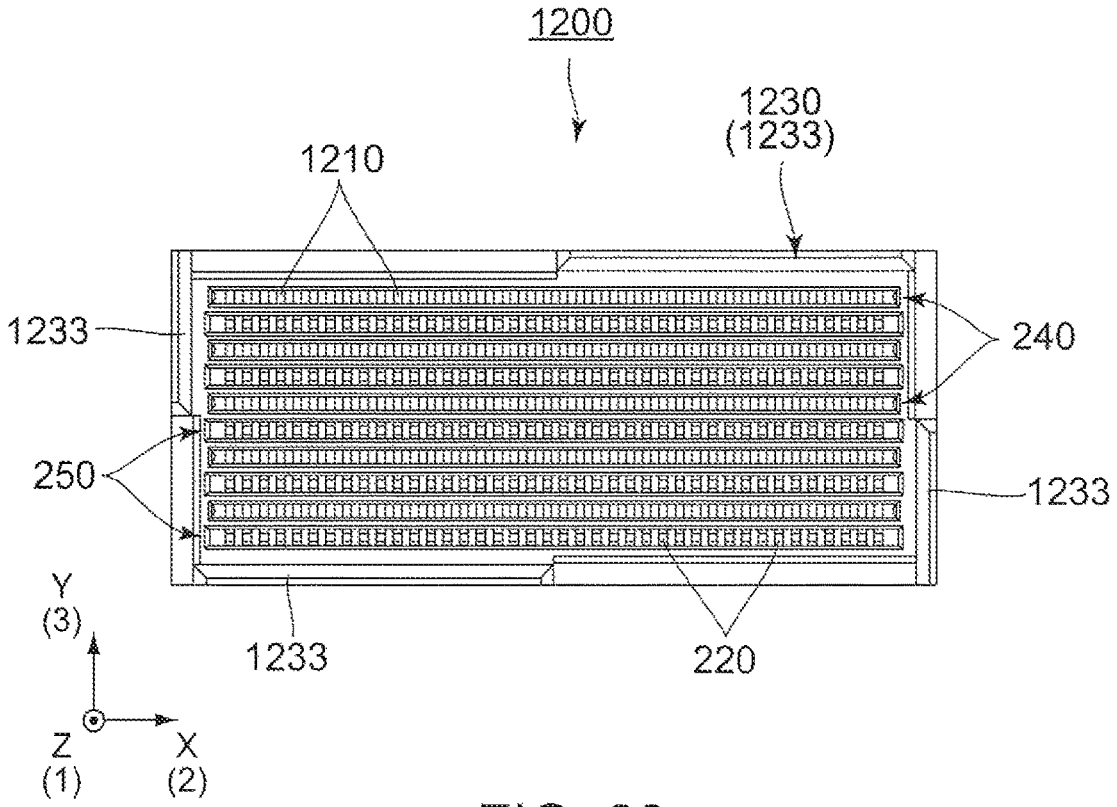
FIG. 23 is a top view of the first connector of FIG. 19.

As shown in FIG. 14, the first contact portion 211 has at least one first contact point that comes into contact with the first mating contact 310. In the present embodiment, the first contact portion 211 has a U-shaped form and two first contact points 214 and 215 which are disposed apart from each other in the third direction.

Referring to FIG. 12, the first fixing portion 212 is fixed to an object (not shown) on which the first connector 200 is mounted when the first connector 200 is used.

The first coupling portion 213 electrically and mechanically couples the first contact portion 211 and the first fixing portion 212 with each other. In the present embodiment, the first coupling portion 213 couples the first contact portion 211 with the first fixing portion 212 linearly. The first coupling portion 213 is arranged on a straight line together with a part of the first contact portion 211 and the first fixing portion 212.

Figure 13:
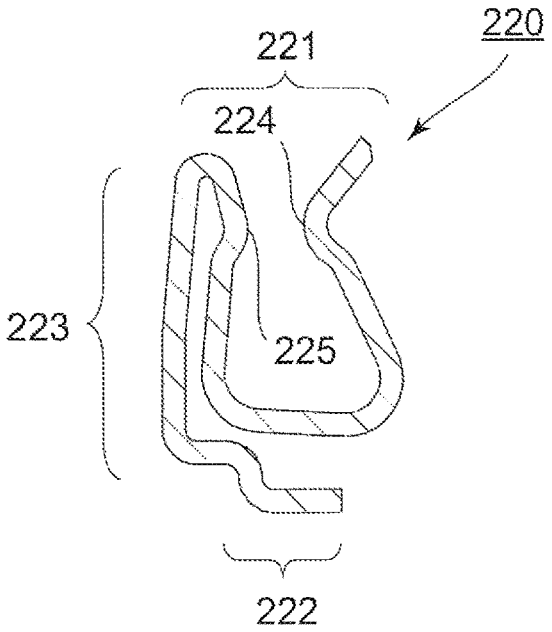
FIG. 13 is an enlarged cross-sectional view of a second contact included in the first connector of FIG. 11.

Referring to FIGS. 13 and 14, each of the second contacts 220 has a second contact portion 221, a second fixing portion 222 and a second coupling portion 223. The second contact portion 221 comes into contact with the second mating contact 320 when the first connector 200 and the second connector 300 are mated with each other. The second fixing portion 222 is fixed to the object (not shown) when the first connector 200 is used. The second coupling portion 223 couples the second contact portion 221 with the second fixing portion 222. The second contact portion 221 has at least one second contact point corresponding to at least one contact point of the second mating contact 320. In the present embodiment, the second contact portion 221 has two second contact points 224 and 225 that are disposed apart from each other in the third direction.

As understood from FIG. 14, the first contact points 214 and 215 come into contact with the first mating contact 310 while the second contact points 224 and 225 come into contact with the second mating contact 320.

Referring again to FIG. 11, the first contact portion 211 of the first contact 210 is supported by the supporting portion 232. Moreover, a surface of the supporting portion 232 does not protrude from a contact surface (or the contact point) of the first contact portion 211. In other words, the surface of the supporting portion 232 is positioned inward in comparison with the surface of the first contact portion 211.

As mentioned above, the first contacts 210 are supported by the supporting portion 232 in the present embodiment. Moreover, the supporting portion 232 is received by the slot 235 of the second connector 300 as understood from FIG. 5 when the first connector 200 and the second connector 300 are mated with each other. Conversely, the supporting portion 232 of the second connector 300 is received by the slot 235 of the first connector 200. The structure allows that the supporting portion 232 receives twist force working between the first connector 200 and the second connector 300 together with the second connector 300 when the twist force is added between the first connector 200 and the second connector 300. Accordingly, the first contact 210 can be prevented from deforming when the twist force is added to the connector assembly 100. Thus, the connector assembly 100 including the first contact 210 is tolerant of the twist.

When seen along the first direction, a position of the first contact portion 211 overlaps with a position of the contact accommodation portion 236, which accommodates a part of the second contact 220 adjacent to the one side (or the negative Y-direction side) of the first contact portion 211. In other words, when the first contact portion 211 and the contact accommodation portion 236 corresponding thereto are projected on a virtual axis extending along the third direction, the first contact portion 211 and the contact accommodation portion 236 overlap with each other.

On the other hand, the second contact portion 221 of the second contact 220 is accommodated by the contact accommodation portion 236 at least in part. The contact accommodation portion 236 has volume which allows resilient deformation of the second contact portion 221 of the second contact 220. This structure allows insertion of the second mating contact 320 between the second contact points 224 and 225 (see FIGS. 13 and 14) by changing an interval between the second contact points 224 and 225 of the second contact 220 in accordance with the insertion of the second mating contact 320 into the slot 235. Reaction force generated by the resilient deformation of the second contact 220 brings the second contact points 224 and 225 into contact with the second mating contact 320 certainly.

According to the present embodiment, the supporting portion 232 extends from the long wall portion 231 defining the slot 235 along the first direction (the Z-direction or a mating direction). That is, there is no space between the long wall portion 231 and the supporting portion 232 in the third direction. Accordingly, the first connector 200 according to the present embodiment can be downsized. Also, the connector assembly 100 can be also downsized, including the first connector 200 and the second connector 300, which has the same structure as the first connector 200. Furthermore, the connector assembly 100 is tolerant of the twist.

It should be noted that, in the first connector 200 according to the present embodiment, a position of the first contact 210 is different from a position of the long wall portion 231 in third direction. Consequently, the first connector 200 can be downsized in comparison with a first connector 1200 according to a second embodiment mentioned later.

Second Embodiment

The following description will be made in detail about the second embodiment of the present invention. In FIGS. 15 to 25, components same as those shown in FIGS. 2 to 14 are designated by the same reference numerals. The description of those components will be omitted. Furthermore, in FIGS. 15 to 25, some components which correspond to the components shown in FIGS. 2 to 14 but have shapes different from the corresponding components are designated by reference numerals having a digit "1" added to the reference numerals used in FIGS. 2 to 14 as the most significant digit.

As understood from FIGS. 15 to 18, a connector assembly 1100 is significantly different from the connector assembly 100 in points of a shape of a housing 1230 of a first connector 1200 (and a second connector 1300) and a shape of a first contact 1210 (and a second mating contact 1320). The housing 1230 is different from the housing 230 in points of the number and shapes of guide portions 1233 and a relative position between the supporting portion 232 and a long wall portion 1231 in the third direction. Regarding other points, the connector assembly 1100 is formed similar to the connector assembly 100.

As understood from FIGS. 19 to 23, the guide portions 1233 is smaller than the guide portions 233 of the first embodiment in number. The guide portions 1233 are larger than the guide portions 233 at least in part. In the second embodiment, the guide portions 1233 located at long sides of the first connector 1200 are larger than the guide portions 233 of the first embodiment. Thus, reduction of the number of the guide portions 1233 simplifies the structure of the first connector 1200. Even though the number of guide portions 1233 is reduced, mating of the first connector 1200 can be guided properly since the guide portions 1233 are enlarged at least in part.

Figure 24:
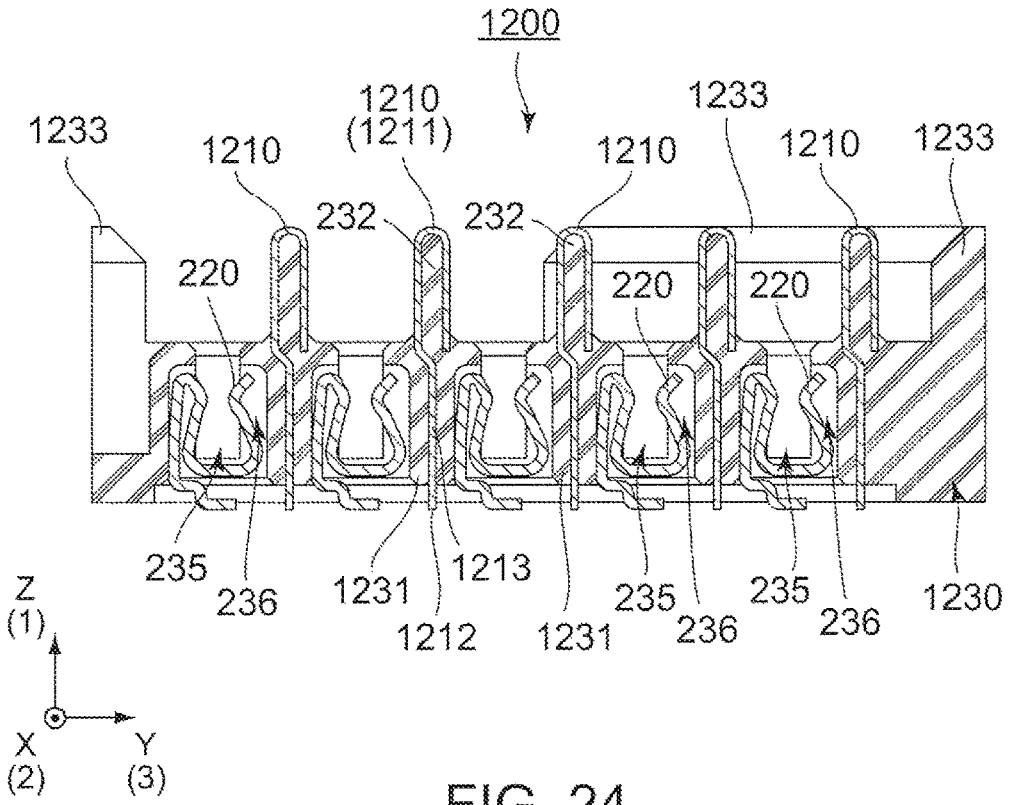
FIG. 24 is a cross-sectional view of the first connector of FIG. 19, taken along D-D line.
Figure 25:
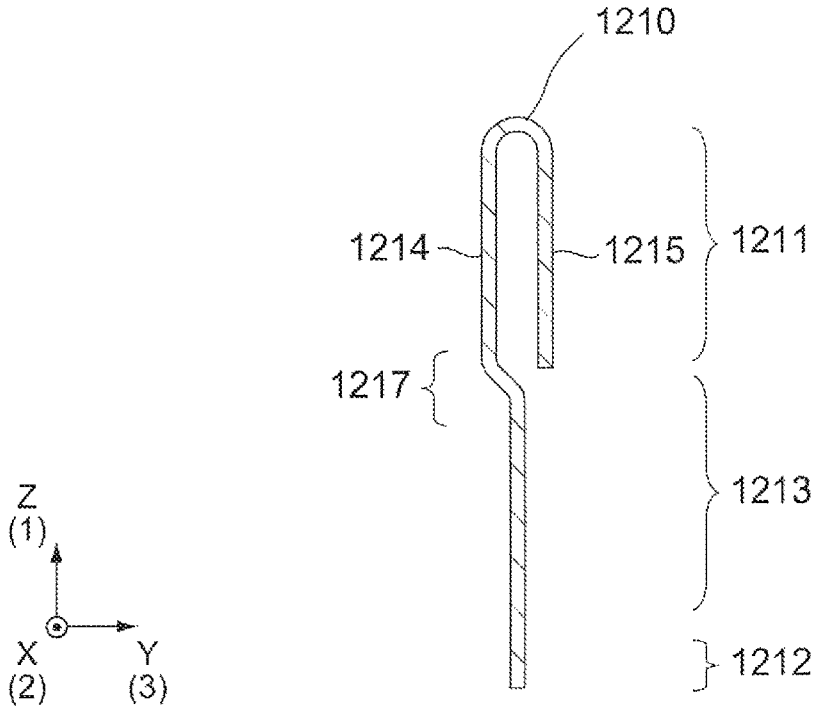
FIG. 25 is an enlarged cross-sectional view of a first contact included in the first connector of FIG. 24.
Figure 26:
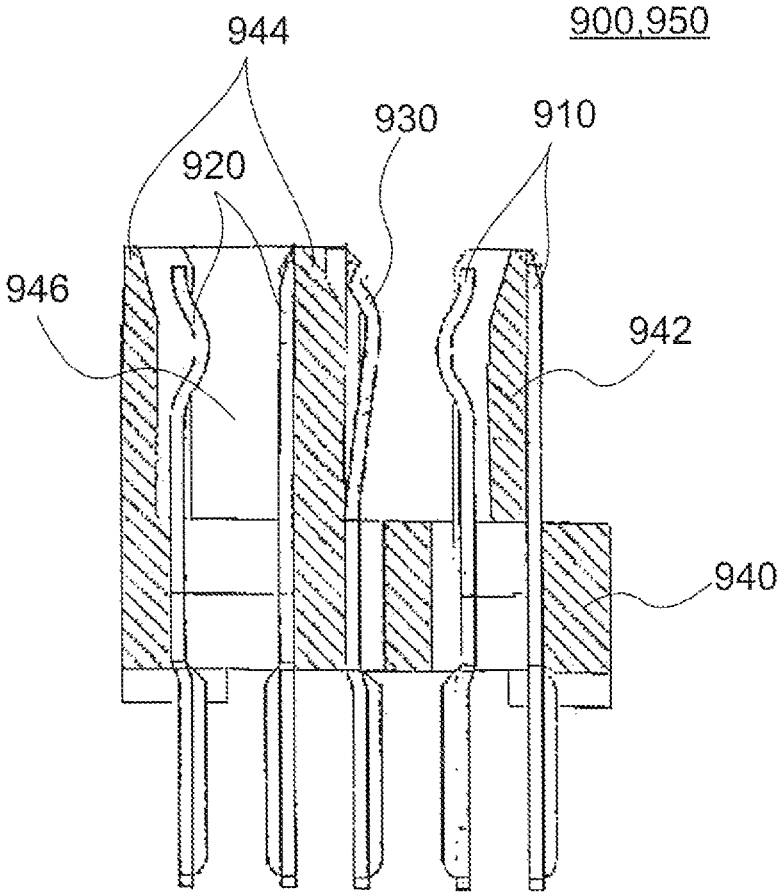
FIG. 26 is a cross-sectional view of a connector disclosed in Patent Document 1.

As understood from FIGS. 24 and 25, each of the first contacts 1210 has a first contact portion 1211, a first fixing portion 1212, and a first coupling portion 1213 coupling the first contact portion 1211 with the first fixing portion 1212.

The first coupling portion 1213 includes an offset portion 1217. The offset portion 1217 is bent so that the first fixing portion 1212 is located between two first contact points 1214 and 1215 in the third direction (or the Y-direction). The offset portion 1217 may be bent so that a middle position between the first contact points 1214 and 1215 is located just above a middle position of the first fixing portion 1212 in the first direction. This structure can locate the first fixing portion 1212 at a middle of the corresponding long wall portion 1231 in the third direction.

Also, the first connector 1200 can be downsized because of no space between each long wall portion 1231 and the corresponding supporting portion 232 in the third direction (or the Y-direction) in the present embodiment. Also, the connector assembly 1100 can be downsized, including the first connector 1200. The connector assembly 1100 is also tolerant of the twist.

Although the preferred embodiments of the invention have been described above in detail, the invention is not limited thereto and various modifications and applications may be made without departing from spirit of the invention. Although the outer shape of the connector is a rectangular shape when saw along the first direction in each of the embodiments mentioned above, it may be another shape, such as a square shape or a round shape, for example. Although the first connector has the U-shaped form in each of the embodiments mentioned above, it may have another shape, such as an I-shape. The shape of the second connector may be modified according to the shape of the first connector.

The present application is based on a Japanese patent application of JP2015-83615 filed before the Japan Patent Office on Apr. 15, 2015, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a first direction, the mating connector having a plurality of first mating contacts and a plurality of second mating contacts, the connector comprising a plurality of first contacts, a plurality of second contacts and a housing which holds the first contacts and the second contacts, wherein:

the first contacts have first contact portions which come into contact with the first mating contacts when the connector is mated with the mating connector;

the second contacts have second contact portions which come into contact with the second mating contacts when the connector is mated with the mating connector;

the housing has at least two long wall portions and at least one supporting portion;

the long wall portions extend in a second direction perpendicular to the first direction;

the long wall portions are disposed apart from each other in a third direction perpendicular to both of the first direction and the second direction to form a slot between the two of the long wall portions;

the supporting portion protrudes in the first direction from one of the long wall portions and has a plate-like shape extending in the second direction;

the first contact portions are supported by the supporting portion;

each of the first contact portions has two contact points located apart from each other in the third direction; and the second contact portions are located in the slot at least in part.

2. The connector as recited in claim 1, wherein:

the housing has three or more of the long wall portions and two or more of the supporting portions;

the housing have two or more slots formed therein; the first contacts form two or more first contact rows;

the first contact rows correspond to the supporting portions, respectively;

the second contacts form two or more second contact rows; and the second contact rows correspond to the slots, respectively.

3. The connector as recited in claim 1, wherein the first contact portion has a U-shaped form.

4. The connector as recited in claim 3, wherein the housing is formed with a contact accommodation portion which communicates with the slot and accommodates each second contact in part; and a position of the first contact portion and a position of the contact accommodation portion overlap with each other when seen along the first direction.

5. The connector as recited in claim 3, wherein the connector is mounted on an object when used;

the first contact has a first fixing portion and a first coupling portion, the first fixing portion is fixed to the object when the connector is mounted on the object;

the first coupling portion couples the first contact portion with the first fixing portion; and the first coupling portion and the first fixing portion are arranged on a straight line.

6. The connector as recited in claim 3, wherein the connector is mounted on an object when used;

the first contact has a first fixing portion and a first coupling portion;

the first fixing portion is fixed to the object when the connector is mounted on the object;

the first coupling portion couples the first contact portion with the first fixing portion; and the first fixing portion is located between the two contact points of the first contact portion in the third direction.

7. The connector as recited in claim 5, wherein the first fixing portion is located at a middle of one of the long wall portions in the third direction.

8. A connector assembly comprising a connector as recited in claim 1 and the mating connector.

9. The connector assembly as recited in claim 8, wherein the connector and the mating connector have shapes same as each other.

* * * * *